US006724377B2

(12) United States Patent
Ouchi et al.

(10) Patent No.: US 6,724,377 B2
(45) Date of Patent: Apr. 20, 2004

(54) IMAGE DISPLAY APPARATUS

(75) Inventors: Takayuki Ouchi, Hitachi (JP); Yoshiro Mikami, Hitachiota (JP); Yoshiyuki Kaneko, Hachioji (JP); Toshihiro Satou, Mobara (JP); Mitsuhisa Fujita, Mutsuzawa (JP)

(73) Assignee: Hitachi, Ltd., Tokyo (JP)

( * ) Notice: Subject to any disclaimer, the term of this patent is extended or adjusted under 35 U.S.C. 154(b) by 141 days.

(21) Appl. No.: 09/940,894

(22) Filed: Aug. 29, 2001

(65) Prior Publication Data

US 2002/0093468 A1 Jul. 18, 2002

(30) Foreign Application Priority Data

Jan. 15, 2001 (JP) ..... 2001-005897

(51) Int. Cl.[7] ..... G09G 3/00

(52) U.S. Cl. ..... 345/204; 345/64; 345/82; 345/60

(58) Field of Search ..... 345/60–65, 76–77, 345/81–84, 87–103, 204–205; 340/815.45

(56) References Cited

U.S. PATENT DOCUMENTS 5,436,634 A * 7/1995 Kanazawa ..... 345/67
6,380,920 B1 * 4/2002 Ozawa ..... 345/100
6,429,836 B1 * 8/2002 Hansen ..... 345/100
6,522,317 B1 * 2/2003 Satou et al. ..... 345/98

FOREIGN PATENT DOCUMENTS

JP 04-186282 * 7/1992 ..... G09G/3/36
JP 10-214060 * 8/1998 ..... G09G/3/30

OTHER PUBLICATIONS

A Proposal of the Drive Method for TV Using AC Type Plasma Display Panel, Mar. 12, 1973, T. Kaji, et al., p. 1–10.

* cited by examiner

*Primary Examiner*—Lun-Yi Lao
(74) *Attorney, Agent, or Firm*—Dickstein Shapiro Morin & Oshinsky LLP

(57) ABSTRACT

A practical-purpose structure of an active-matrix display device digitally driven with vertical scanning being multiplexed includes a vertical driver having sequential circuits and logic circuits provided on a bit-by-bit basis and arranged for adding sequentially products of outputs of the sequential circuit/logic circuit and a control signal for dividing a horizontal scanning period, and a horizontal driver having line latches provided on a bit-by-bit basis and arranged for adding sequentially products of outputs of the line latches and the control signal for dividing the horizontal scanning period. Enhanced luminance of display, manufacturing at low cost and high image quality can be realized with a reasonable wiring density.

15 Claims, 8 Drawing Sheets

11-0,11-1,11-2,11-3 : SHIFT REGISTER
12-0,12-1,12-2,12-3 : LINE LATCH

IMAGE DISPLAY APPARATUS

BACKGROUND OF THE INVENTION

The present invention generally relates to an image display apparatus of an active-matrix type and particularly to an image display apparatus designed for holding a signal voltage written or inputted during a given selected period over a time span extending beyond that selected period for the purpose of controlling the electro-optical characteristics of the display elements by the above-mentioned signal voltage. In more particular, the present invention is concerned with an image display apparatus which is capable of displaying images with a multiplicity of gradation levels (gray scale levels) by controlling the period for which the above-mentioned signal voltage represented by a binary-level voltage signal is to be held in accordance with the level of a picture signal to be displayed.

In recent years, with the advent of the highly sophisticated information society, there exists an increasing demand for personal computers, portable information terminals, information communication equipment and/or combined apparatuses or systems thereof. In these apparatuses or systems, a display device implemented in a thin and light-weight structure and capable of responding at a high speed is advantageously suited. To this end, the display device implemented by employing organic LED (light emitting diode) elements (also called OLED in abbreviation) of spontaneous light emission type or the like has been developed and used for practical applications. For better understanding of the present invention, brief description will first be made of a conventional display device known heretofore. FIG. 1A of the accompanying drawings shows a circuit structure of a pixel (picture element) in an organic LED display apparatus. Referring to the figure, a first thin-film transistor (TFT) Tsw 23 (hereinafter also referred to simply as the first TFT 23) is provided at an intersection between a gate line (or gate wire) 22 and a data bus line 21. Connected to the first TFT Tsw 23 are a capacitor Cs 25 for storing a data current and a second thin-film transistor (TFT) Tdr 24 (hereinafter also referred to simply as the second TFT 24) for controlling the current allowed to flow to an organic LED (OLED) 26. FIG. 1B is a waveform diagram illustrating waveforms of voltages for driving the pixel components mentioned above. Referring to FIG. 1B, a voltage conforming to a data signal Vsig is applied to a gate electrode of the second TFT 24 via the first TFT 23 which is turned on in response to a gate voltage Vgh 28. Conductivity of the second TFT 24 is determined in dependence on the signal voltage applied to the gate thereof. A voltage Vdd applied to a current supply line 27 is divided between the TFT and the organic LED element 26 constituting a load element, as a result of which the current flowing to the organic LED element 26 is determined. In this conjunction, it is noted that with the arrangement in which the data signal Vsig can assume a multiplicity of values in terms of analog signal, it is required that the characteristics of the second TFTs be homogeneous over the display area of the display apparatus. However, in practice, difficulty is encountered in satisfying the above requirement because of non-homogeneousness of the electric characteristics of the TFTs having the respective active layers formed of poly crystal silicon (i.e., not single crystal silicon).

With a view to solving the problem mentioned above, such a digital drive scheme has been proposed according to which the second TFT is employed as a switch so that the current which flows to the organic LED element can assume binary values or levels, i.e., on- and off-levels, respectively. Display with the gradation can be realized by controlling the time during which the current is allowed to flow. This sort of arrangement is described, for example, in Japanese Patent Application Laid-Open Publication No. 214060/1998 (JP-A-10-214060). FIG. 2 of the accompanying drawings is a view for illustrating a drive scheme disclosed in the above publication. In the figure, positions of vertical scanning lines are taken along the ordinate with the time taken along the abscissa for a single frame. According to the driving principle taught in the above publication, the single frame period is divided into four subframes, wherein each of the subframes includes a vertical scanning period having a common duration throughout the subframes and a light emission period whose duration differs from one to another subframe, being weighted 1, 2, . . . , $2^4$=64.

With the drive scheme in which the vertical scanning period and the light emission period are separated from each other as described above, the proportion of the time for light emission within one frame is shortened because the vertical scanning period can not naturally be utilized for the light emission. Accordingly, the vertical scanning period has to be shortened in order to ensure the light emission period. However, since the first thin-film transistor (TFT) Tsw is turned on during a time approximately corresponding to a quotient of division of the vertical scanning period by the number (m) of the vertical scanning lines (i.e., vertical scanning period/vertical scanning line number (m)), the vertical scanning period of a sufficient duration is necessarily required in order to ensure the above-mentioned on-time of the first TFT Tsw when taking into consideration the wiring capacitance, resistance and the like factors inherent to the active matrix. By way of example, in the case of the display with eight subframes, it is expected that the vertical scanning period on the order of about 1 ms is required for each subframe. In that case, the time available for the light emission is about 8 ms which corresponds to a half of the frame. Additionally, it is required that the single vertical scanning has to be carried out at a rate about sixteen times as high the ordinary scanning, giving rise to problems.

The problems mentioned above can be solved by multiplexing the vertical scanning so that the vertical scanning and the light emission can proceed simultaneously. In that case, the drive scheme will be such as illustrated in FIG. 3. More specifically, shown in FIG. 3 is an example of three-bit drive, wherein situation in which three vertical scannings and display are in progress is illustrated. The basic concept underlying this drive scheme has first been disclosed in Image System Study Data 11-4, "GENERATION OF HALF-TONE ANIMATION BY AC-TYPE PLASMA DISPLAY" published by the Institute of Television Engineers of Japan (Mar. 12, 1973), and an example of application of this concept to an active-matrix liquid crystal is suggested in Patent Publication No. 2954329 as well. However, in the case of the liquid crystal device proposed in the above-mentioned patent publication, high response performance is necessarily required in practice. Such being the circumstances and as a result of development of the technique concerning the analog display with the response rate slower than the frame period, the structure for actually implementing the above-mentioned drive scheme has not seen the light yet.

On the other hand, in the present state of the art, the organic LED display based on the active-matrix scheme which is advantageously suited for the digital drive with high response rate is now available, as described hereinbefore, as a result of which there has arisen a demand for a structure or arrangement capable of driving the organic LED display for practical applications.

SUMMARY OF THE INVENTION

In the light of the state of the art described above, it is contemplated with present invention to realize a structure of the image display apparatus of an active-matrix type which can generate displays through digital drive by multiplexing the vertical scanning for allowing the display period and the vertical scanning period to proceed simultaneously.

Thus, it is an object of the present invention to provide an image display apparatus which can generate or display bright and high-quality images for practical application.

Another object of the present invention is to provide an image display apparatus which can be implemented at low cost while mitigating a load imposed on a vertical drive circuit.

In view of the above and other objects which will become apparent as the description proceeds, there is provided according to an embodiment of the present invention an image display apparatus of an active-matrix type arranged such that digital data including a number of bits is applied to a number of sequential circuits which is at least equal to the number of bits, to thereby determine voltage state for a single vertical scanning line on the basis of result of logical operation performed on the outputs of the sequential circuits. Further, the arrangement mentioned above is multiplexed such that the digital data are applied in parallel to line latches provided in a number at least equal to the number of bits to be outputted in synchronism with multiplexed vertical scannings.

Furthermore, according to another embodiment of the present invention, an image display apparatus includes a display unit and a drive circuit unit formed on a substrate. The image display apparatus is designed to display an image signal of digital data having a number n of bits with a number of gradation levels determined by the bit number n, wherein the drive circuit unit comprises a number of sequential circuits which is not smaller than the bit number n at the least and logic circuits connected to output sides of the sequential circuits, respectively.

Furthermore, the drive circuit unit includes a vertical drive circuit, wherein the vertical drive circuit comprises a number of sequential circuits which is not smaller than the bit number n at the least and logic circuits connected to output sides of the sequential circuits, respectively.

According to yet another embodiment of the present invention, an image display apparatus includes a display unit and a drive circuit unit formed on a substrate. The image display apparatus is designed to display an image signal of digital data having a number n of bits with a number of gradation levels determined by the bit number n, wherein the drive circuit unit is comprised of line data latch circuits in a number not smaller than the bit number n at the least and so arranged as to control the drive circuit unit in dependence on results of sequential additions of logical signals representing products of bit-based outputs of the line data latch circuits and a control signal for dividing the horizontal scanning period.

Additionally, the drive circuit unit includes a horizontal drive circuit, wherein the horizontal drive circuit is comprised of line data latch circuits in a number not smaller than the bit number n at the least and so arranged as to control the drive circuit unit in dependence on results of sequential additions of logical signals representing products of bit-based outputs of the line data latch circuits and a control signal for dividing horizontal scanning period.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which.

DESCRIPTION OF THE EMBODIMENTS

Figure 1A:
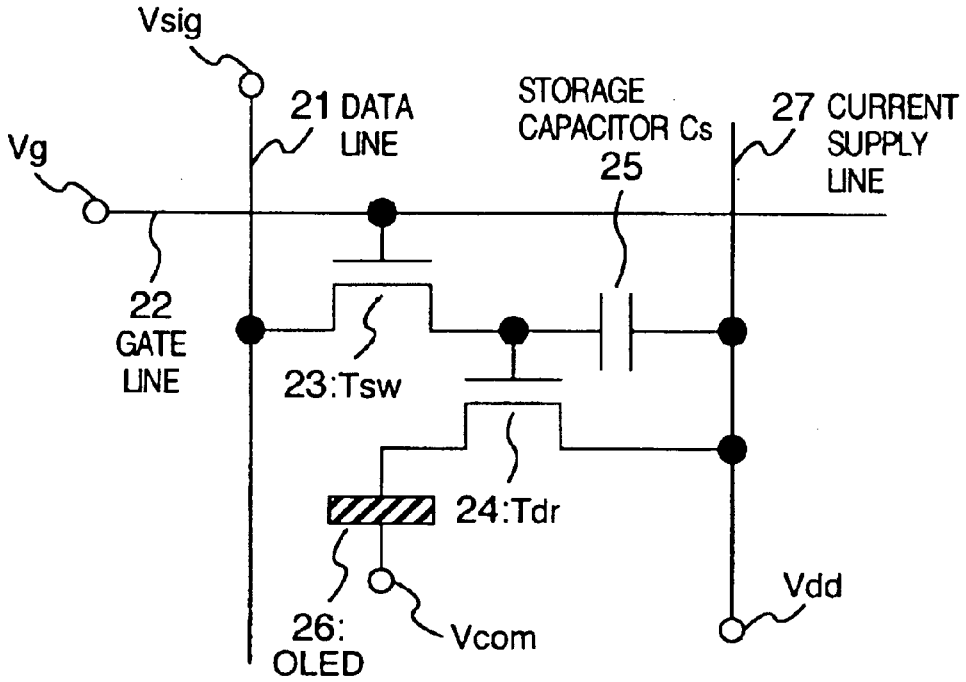
FIG.1A PRIOR ART
FIG. 1A is a view showing a pixel structure in a conventional organic LED display apparatus.
Figure 1B:
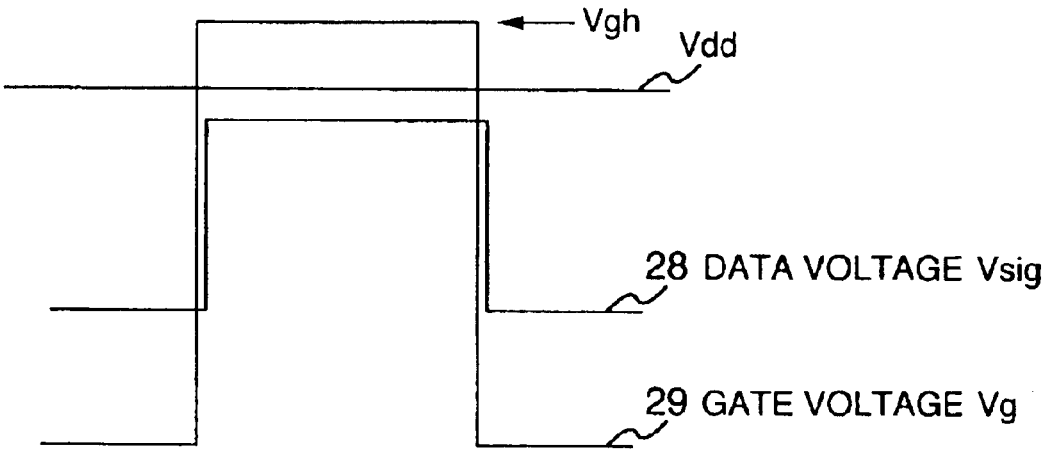
FIG.1B PRIOR ART
FIG. 1B is a waveform diagram illustrating voltage waveforms for driving the pixel shown in FIG. 1A.
Figure 2:
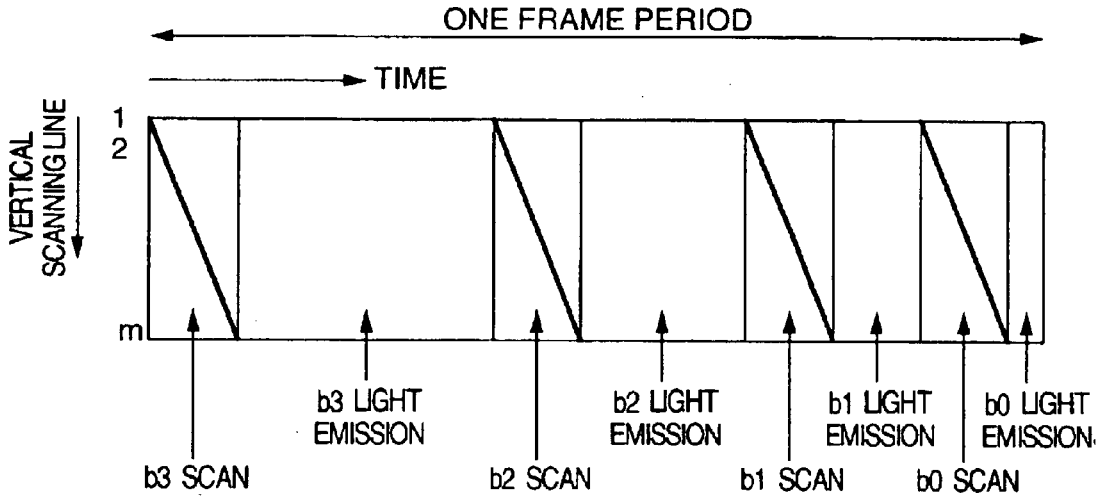
FIG.2 PRIOR ART
FIG. 2 is a view for illustrating a digital drive scheme for a conventional organic LED display apparatus.
Figure 3:
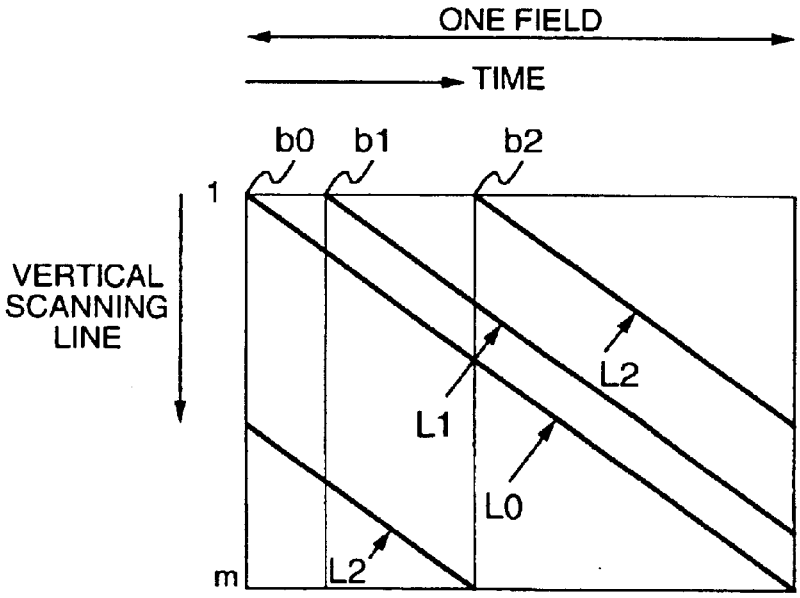
FIG.3 PRIOR ART
FIG. 3 is a view for illustrating a drive scheme for an organic LED display with vertical scanning being multiplexed.

The present invention will be described in detail in conjunction with what is presently considered as preferred or typical embodiments thereof by reference to the drawings. In the following description, like reference characters designate like or corresponding parts throughout the several views.

Figure 4:
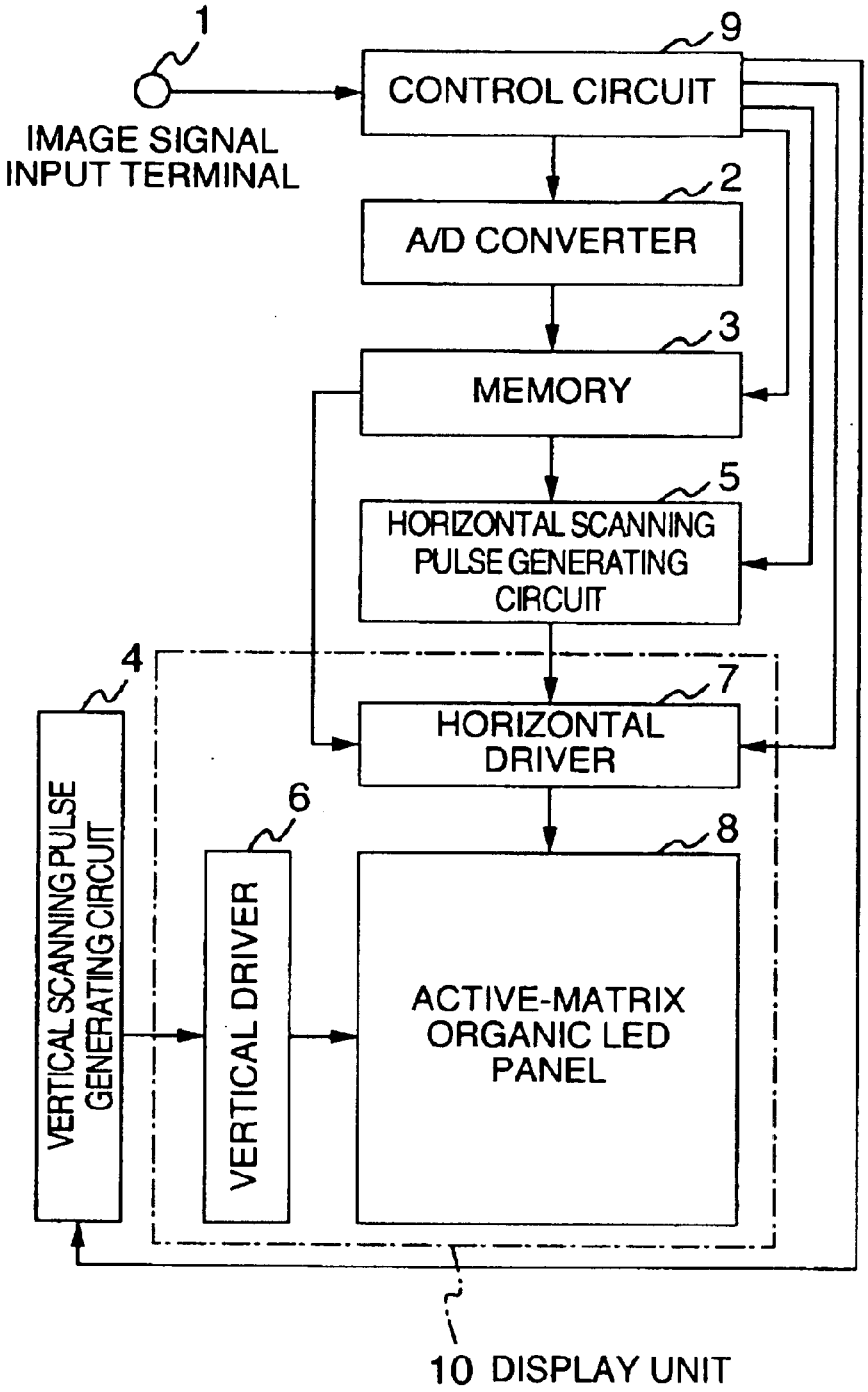
FIG. 4 is a block diagram showing schematically and generally major parts of an image display apparatus according to an embodiment of the present invention.

FIG. 4 is a block diagram showing schematically and generally major parts of an image display apparatus according to an embodiment of the present invention. Referring to the figure, the image display apparatus is comprised of an image signal input terminal 1, an A/D (analog-to-digital) converter 2, a memory 3, a vertical scanning pulse generating circuit 4, a horizontal scanning pulse generating circuit 5, a vertical driver 6, a horizontal driver 7, an active-matrix organic LED panel 8 and a control unit 9. Parenthetically, the vertical driver 6, the horizontal driver 7 and the active-matrix organic LED panel 8 will collectively be referred to as a display unit 10 only for the convenience of description. Incidentally, the display unit 10 is arranged to be driven by TFT circuitries implemented on one and the same substrate. In the following, description will be made of operations of the individual components shown in a block in FIG. 4. The control unit 9 is designed to generate various control signals in synchronism with the image signal inputted for supplying the control signals to the relevant components or circuits. The vertical scanning pulse generating circuit 4 is designed to generate a pulse signal for vertically scanning the active-matrix organic LED panel 8 on the basis of the control signal supplied from the control unit 9 for thereby scanning the organic LED panel 8 by way of the vertical driver 6. The horizontal scanning pulse generating circuit 5 is designed to fetch the image signal from the memory 3 on a bit-by-bit basis in synchronism with the control signal supplied from the control unit 9 to thereby generate write pulses for the display pixels arrayed in the horizontal direction. These write pulses are applied to the organic LED panel 8 in timing with the vertical scanning through the medium of the horizontal driver 7.

Figure 5:
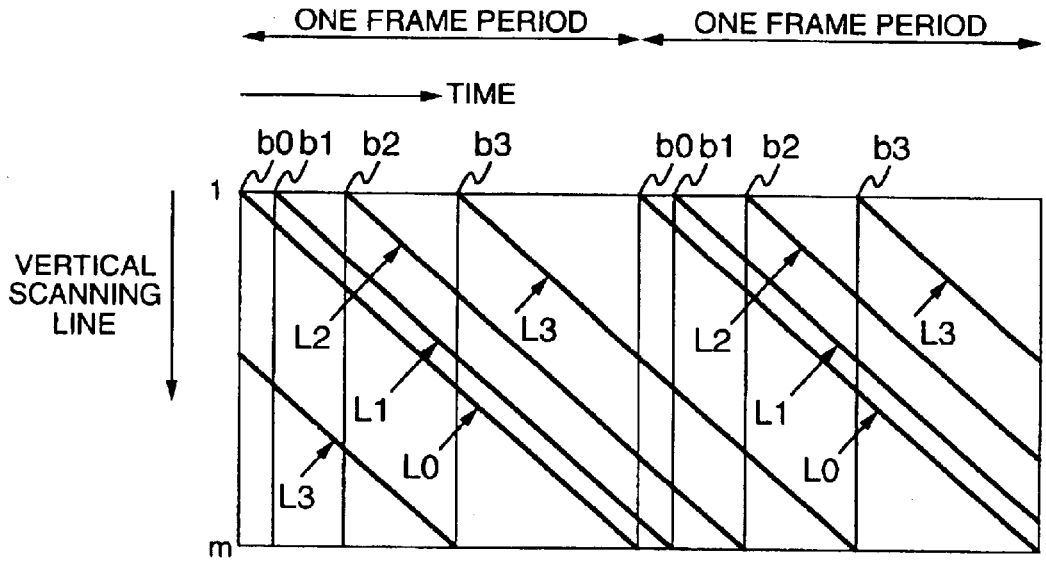
FIG. 5 is a view for illustrating a drive scheme according to an embodiment of the invention.

In the display unit 10, predetermined binary voltages which correspond to the individual bits of the digital data obtained through A/D conversion of the image signal are outputted from the horizontal driver 7 to the pixels in the row selected by the vertical driver 6, whereby the predetermined voltages are written in the relevant pixels, respectively. The active-matrix organic LED panel of the display unit 10 should preferably have a display area composed of 320 pixels in the horizontal direction and 229 pixels in the vertical direction, i.e., 320×229 pixel array. In the active-matrix drive of the display unit 10, gradational display can be realized by carrying out the multiplexed vertical scanning illustrated in FIG. 5. Incidentally, FIG. 5 is depicted on the presumption that the image signal represents 4-bit digital data. Referring to the figure, the bits of the least significance (LSB) to the most significance (MSB) are designated by b0, b1, b2 and b3, respectively. In that case, scanning may be performed on a time-division basis by shifting the phase along the solid lines L0, L1, L2 and L3 in correspondence to the individual bits, respectively, i.e., through time division scanning. By virtue of the scanning described above, the light emission time of the organic LED in each of the pixels can be controlled in accordance with the digital data. As a result of this, display with 16 gradation-levels (16 levels of gray scale) can be realized for the 4-bit digital data.

Figure 6:
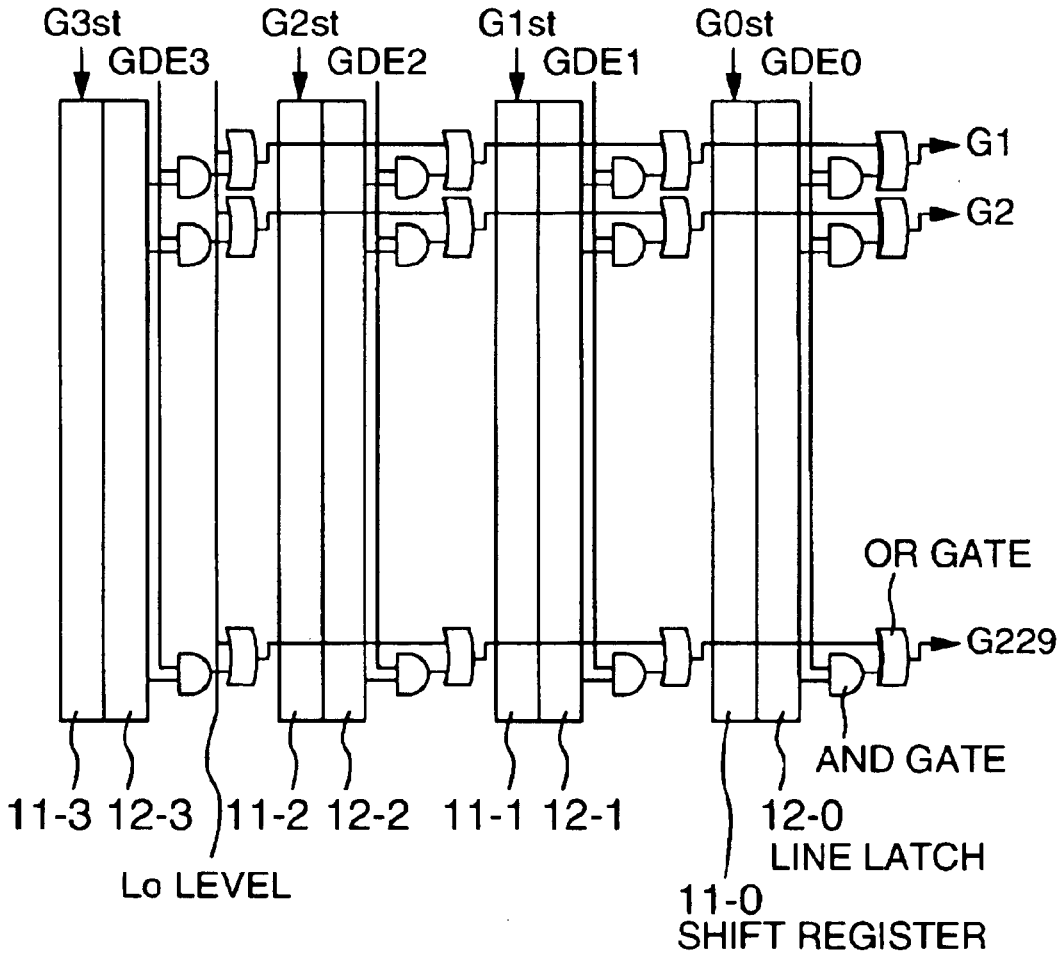
FIG. 6 is a schematic circuit diagram showing a circuit arrangement of a vertical driver according to an embodiment of the invention.

FIG. 6 is a schematic circuit diagram showing a circuit arrangement of the vertical driver 6. The circuit arrangement shown in this figure features that the signals for the vertical scanning control are sequentially added together on a bit-by-bit basis. More specifically, referring to the figure, shift registers 11-0, 11-1, 11-2 and 11-3 provided in a number corresponding to the bit number, i.e., four series of shift registers, start respective shift operations in response to start pulses G0st, G1st, G2st and G3st, respectively. The outputs of these shift registers are inputted to logic circuits 12-0, 12-1, 12-2 and 12-3, respectively, and then the outputs of the logic circuits are logically ANDed with the gradation control signals GDE0, GDE1, GDE2 and GDE3, respectively, on a bit-by-bit basis, wherein at the time point when the final output assumes high level, the signal Vgh is applied for turning on the TFTs (Tsw) connected to vertical scanning lines G1, G2, . . . , G229, respectively.

Figure 7A:
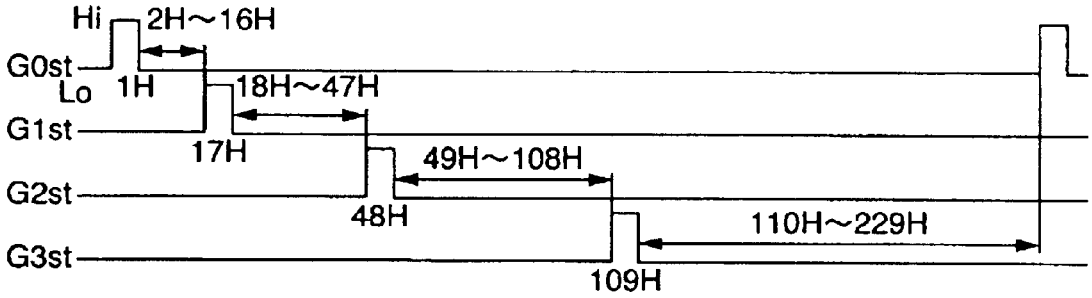
FIG. 7A is a waveform diagram showing waveforms of signals for controlling the vertical driver shown in FIG. 6.
Figure 7B:
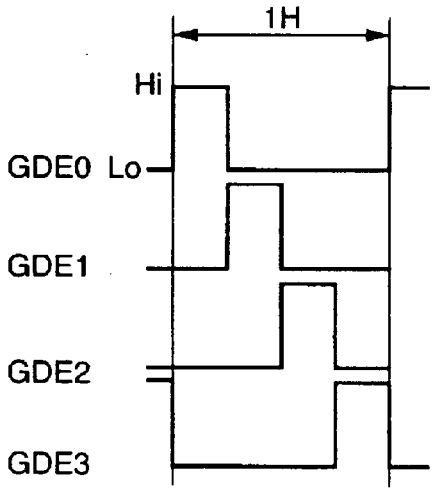
FIG. 7B is a waveform diagram showing data output control signals in the vertical driver shown in FIG. 6.

FIGS. 7A and 7B are waveform diagrams showing waveforms of control signal applied to the vertical driver of the structure described above. At first, the start pulse G0st is turned on at a time point t=0 and maintained in the on-state during the first horizontal scanning period (1H), as is shown in FIG. 7A. Next, after lapse of a period of 15 horizontal scanning periods (15H), the start pulse G1st is turned on during the 17-th horizontal scanning period. Subsequently, after 30 horizontal scanning periods (30H), the start pulse G2st is turned on during the 48-th horizontal scanning period, which is then followed by application of the start pulse G3st during the 109-th horizontal scanning period after lapse of 60 horizontal scanning periods (60H). The periods intervening the start pulses are made available for the light emission. Referring to FIG. 7B, one horizontal scanning period (i.e., 1H) is equally divided into subperiods or pulses GDE0, GDE1, GDE2 and GDE3 in this sequence. By applying this pulse train to the vertical driver of the structure shown in FIG. 6, then a voltage Vgh which turns on the TFT about one-fourth horizontal scanning period (i.e., period of H/4) is applied to the first vertical scanning line G1 at the time points 0, 16H+(¼)H, 46H+(2/4)H and 107H+(3/4) H, respectively, where H represents one horizontal scanning period. Since one horizontal scanning period (H) is divided by the bit number, such situation can positively be avoided that the TFTs connected to a plurality of the vertical scanning lines are turned on at a same time with the signals being intermixed or blended. The vertical driver of the structure described above features that the number of bits for display can easily be increased without incurring increase of overhead for the wiring in the vertical direction by adding the shift register, logic circuit and the ANDing circuit in the form of a unit. Further, for the on-time of each of the TFTs connected to one vertical scanning line, a time corresponding to a quotient of division of one horizontal scanning period (1H) by the bit number can be allotted at maximum. In the case where the bit number is four, the on-time mentioned above may be about 4 ms with a quad-speed, while in the case where the bit number is eight, it may be about 2 ms with an eight-speed. Thus, double tolerance can be imparted when compared with the conventional apparatus. Further, approximately one frame period can be allotted for the light emission time in total, which means that the efficiency of light emission can be enhanced. Further, by virtue of the aforementioned structure in which the unit for the most significant bit is disposed at the position far from the active matrix, distortion due to delay of the digital signal, if occur, can be absorbed because of elongation of the light emission period.

Figure 8:
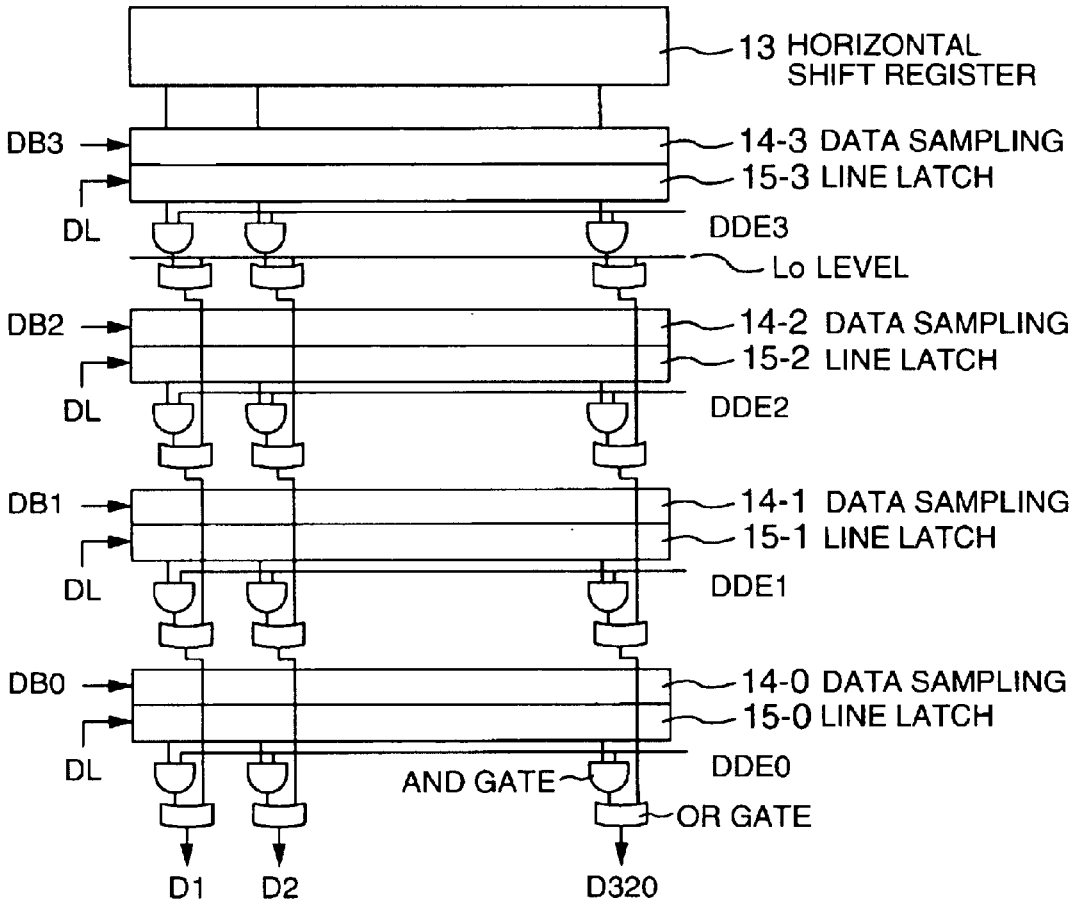
FIG. 8 is a schematic circuit diagram showing a circuit arrangement of a horizontal driver according to an embodiment of the invention.
Figure 9A:
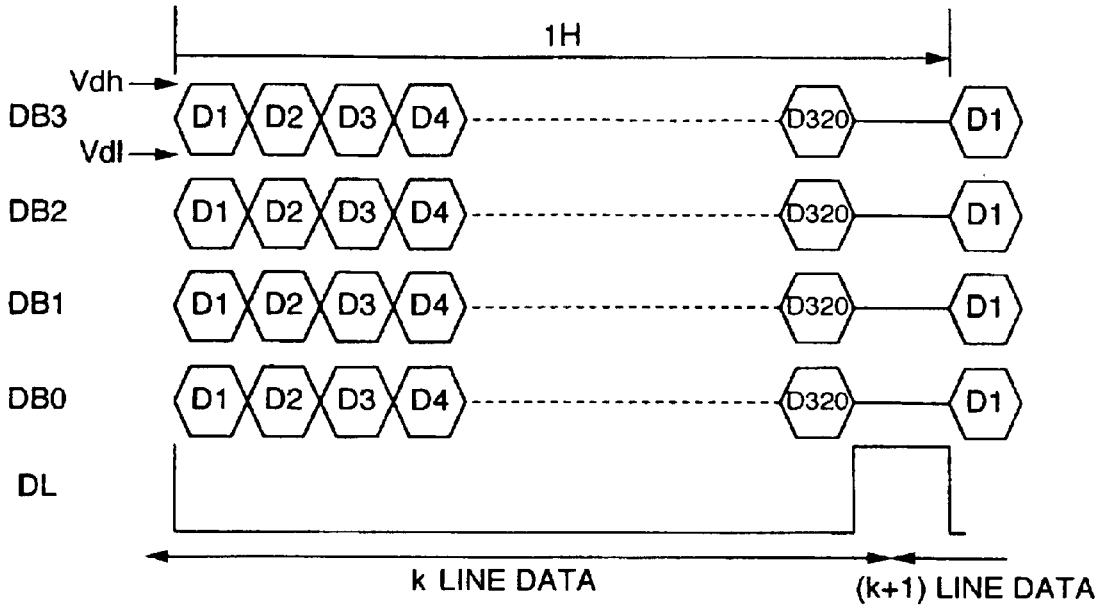
FIG. 9A is a waveform diagram showing waveforms of signals for controlling the horizontal driver shown in FIG. 8.
Figure 9B:
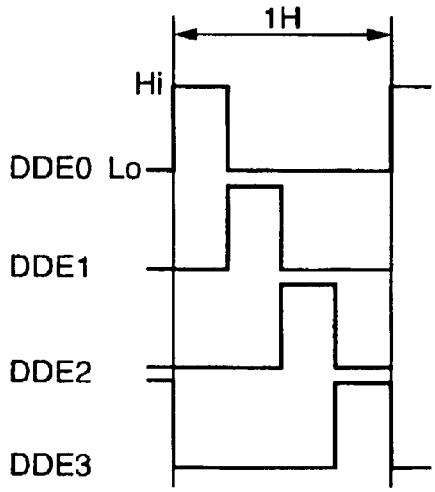
FIG. 9B is a waveform diagram showing data output control signals in the horizontal driver shown in FIG. 8.

Next, referring to FIG. 8, description will be made of the horizontal driver 7. The horizontal driver 7 is composed of a single horizontal shift register 13 and latch circuits 15-0, 15-1, 15-2 and 15-3 provided on a bit-by-bit basis, wherein the outputs of these latch circuits and the data output control signals DDE0, DDE1, DDE2 and DDE3 are logically ANDed sequentially. And D1, D2, D3, D4–D320 are data signal lines. Basic drive signal waveforms are illustrated in FIGS. 9B. Inputted to the individual latch circuits by way of data buses DB0, DB1, DB2 and DB3 in parallel are four bits of the image data undergone the A/D conversion. This data input operation is repeated 320 times corresponding to the pixel number in the horizontal direction within one horizontal scanning period (1H) in synchronism with the output of the shift register. Thereafter, the data are stored in the line memory incorporated in the latch circuit in response to the data latch signal DL. During the succeeding horizontal scanning period (1H), the data output control signals DDE0, DDE1, DDE2 and DDE3 are sequentially turned on, as a result of which a high-level voltage Vdh and a low-level voltage Vdl are applied to the data line in conformance with the digital data in the order of the least significant bit to the most significant bit. The timing at which the voltage is applied to the data line mentioned above is made to coincide with the timing for the vertical scanning described previously. In this way, application of the high-level voltage Vdh for the data of the least significant bit is sustained over 15 horizontal scanning periods (15H), while application of the low-level voltage Vdl for the most significant bit is sustained over 120 horizontal scanning periods (120H).

As is apparent from the foregoing, in the display unit 10, the current flowing to the organic LED is so controlled as to assume binary values or levels, i.e., on and off levels. More specifically, in the switch transistor constituting a part of the pixel, the gate signal Vgh bears such relation to the data signals Vdh and Vdl that the switch transistor operates in the non-saturated state, while in the driver transistor, the data signal Vdh bears such relation to the applied voltage Vdd applied to the current supply line for the organic LED that the driver transistor operates in the non-saturated state. The storing capacitor Cs then serves to suppress variation of the gate voltage of the driver transistor when the switch transistor is in the off-state to thereby protect the display with gradation against undesirable change due to variation of the current flowing to the organic LED.

At this juncture, it should be mentioned that the present invention is never restricted to the embodiments described above. By way of example, it has been presumed that each pixel incorporates two TFTs. However, it goes without saying that more than two TFTs may be employed to this end. Furthermore, although it has been described that the horizontal driver and the vertical driver are implemented by using the TFTs, the object contemplated by the invention can be achieved so far as the interconnection circuitries for the active-matrix portion are implemented by the TFTs. By way of example, the shift register portion of the vertical driver may be implemented in the form of an integrated circuit designed to be externally mounted.

Additionally, although the invention has been described in conjunction with the organic LED display, it goes without saying that the structure of the driving circuit for the organic LED display may be applied to the other types of active-matrix type display device such as liquid crystal device of high switching rate, a display in which electric field emission devices (FED) are used and the like.

As will now be understood from the foregoing description, according to the teachings of the present invention incarnated in the illustrated embodiments, the image display element driven by controlling the binary state of the display elements in conformance with the digital data are so arranged that the proportion at which the display period occupies the frame period can be increased with the time duration allotted to the vertical scanning being extended as well. Thus, there can be realized inexpensively the image display apparatus which is capable of generating the bright image display with high quality while at the same time reducing the load imposed to the vertical drive circuit, to great advantages.

The present invention has thus provided the image display apparatus which is capable of generating the bright image display with high quality.

What is claimed is:

1. An image display apparatus for displaying an image signal representing digital data of n bits with a number of gradation levels determined by the bit number n, comprising:

a display panel implemented by disposing display elements each capable of sustaining displayed state of a signal written in a given selected period over a period other than said selected period in a matrix-like array of pixels;

a vertical drive circuit for scanning sequentially and selectively on a row-by-row basis said display elements of said matrix-like array constituting said display panel; and a horizontal drive circuit for writing a voltage from voltages previously assigned with binary values in conformance with the digital data of the image signal to be displayed to the display elements of the row selected by said vertical drive circuit;

said horizontal drive circuit and said vertical drive circuit being so designed as to selectively scan said display pixels at least n times within a single frame period in synchronism with said image signal to be displayed for thereby displaying said image signal with multiple gradation levels;

wherein said vertical drive circuit includes at least a number of sequential circuits not smaller than said bit number n and logic circuits for processing outputs of said sequential circuits.

2. An image display apparatus according to claim 1, wherein said vertical drive circuit and said horizontal drive circuit are each constituted by thin-film transistors on an active-matrix substrate.

3. An image display apparatus according to claim 1, wherein each of said display elements is comprised of a first thin-film transistor having a gate electrode connected to a vertical scanning line of the active matrix and a drain electrode connected to a horizontal scanning line of the active matrix, a second thin-film transistor having a gate electrode connected to a source electrode of said first thin-film transistor, a charge storing capacitor having an electrode connected to said source electrode of said first thin-film transistor, and an organic LED connected to said second thin-film transistor, wherein during a period in which the image signal is held in said storing capacitor, a current continuously flows to said organic LED, for thereby sustaining the display state.

4. An image display apparatus according to claim 3, wherein said vertical drive circuit and said horizontal drive circuit are each constituted by thin-film transistors on an active-matrix substrate.

5. An image display apparatus according to claim 1, wherein said vertical drive circuit is so arranged as to determine the voltage to be applied to vertical scanning lines of said active matrix in accordance with a result of sequential additions of logical signals representing logical products of results of bit-based logical operations for the outputs of said sequential circuits and a control signal for dividing a horizontal scanning period.

6. An image display apparatus according to claim 5, wherein each of said display elements is comprised of a first thin-film transistor having a gate electrode connected to a vertical scanning line of the active matrix and a drain electrode connected to a horizontal scanning line of the active matrix, a second thin-film transistor having a gate electrode connected to a source electrode of said first thin-film transistor, a charge storing capacitor having an electrode connected to said source electrode of said first thin-film transistor, and an organic LED connected to said second thin-film transistor, wherein during a period in which the image signal is held in said storing capacitor, a current continuously flows to said organic LED, for thereby sustaining the display state.

7. An image display apparatus according to claim 5, wherein said vertical drive circuit and said horizontal drive circuit are each constituted by thin-film transistors on an active-matrix substrate.

8. An image display apparatus for displaying an image signal representing digital data of n bits with a number of gradation levels determined by the bit number n, comprising:

a display panel implemented by disposing display elements each capable of sustaining displayed state of a signal written in a given selected period over a period other than said selected period in a matrix-like array of pixels;

a vertical drive circuit for scanning sequentially and selectively on a row-by-row basis said display elements of said matrix-like array constituting said display panel; and a horizontal drive circuit for writing a voltage from voltages previously assigned with binary values in conformance with the digital data of the image signal to be displayed to the display elements of the row selected by said vertical drive circuit;

said horizontal drive circuit and said vertical drive circuit being so designed as to selectively scan said display pixels at least n times within a single frame period in synchronism with said image signal to be displayed for thereby displaying said image signal with multiple gradation levels;

wherein said vertical drive circuit is comprised of line data latch circuits in a number not smaller than said bit number n at the least and so arranged as to output a driving voltage for said active matrix display elements in dependence on a result of sequential additions of logical signals representing products of bit-based outputs of said line data latch circuits and a control signal for dividing horizontal scanning period.

9. An image display apparatus according to claim 8, wherein said vertical drive circuit is so arranged as to determine the voltage to be applied to vertical scanning lines of said active matrix in accordance with a result of sequential additions of logical signals representing logical products of results of bit-based logical operations for the outputs of said sequential circuits and a control signal for dividing a horizontal scanning period.

10. An image display apparatus according to claim 8, wherein each of said display elements is comprised of a first thin-film transistor having a gate electrode connected to a vertical scanning line of the active matrix and a drain electrode connected to a horizontal scanning line of the active matrix, a second thin-film transistor having a gate electrode connected to a source electrode of said first thin-film transistor, a charge storing capacitor having an electrode connected to said source electrode of said first thin-film transistor, and an organic LED connected to said second thin-film transistor, wherein during a period in which the image signal is held in said storing capacitor, a current continuously flows to said organic LED, for thereby sustaining the display state.

11. An image display apparatus according to claim 8, wherein said vertical drive circuit and said horizontal drive circuit are each constituted by thin-film transistors on an active-matrix substrate.

12. An image display apparatus comprising a display unit and a drive circuit unit formed on a substrate, said image display apparatus being designed to display an image signal of digital data having a number n of bits with a number of gradation levels determined by said bit number n, wherein said drive circuit unit comprises a number of sequential circuits which is not smaller than said bit number n at the least and logic circuits connected to output sides of said sequential circuits and connected to a common output line for processing output data from said sequential circuits.

13. An image display apparatus according to claim 12, said drive circuit unit comprises a vertical drive circuit, wherein said vertical drive circuit comprises a number of sequential circuits which is not smaller than said bit number n at the least and logic circuits connected to output sides of said sequential circuits, respectively.

14. An image display apparatus comprising a display unit and a drive circuit unit formed on a substrate, said image display apparatus being designed to display an image signal of digital data having a number n of bits with a number of gradation levels determined by said bit number n, wherein said drive circuit unit is comprised of line data latch circuits in a number not smaller than said bit number n at the least and so arranged as to control said display unit in dependence on results of sequential additions of logical signals representing products of bit-based outputs of said line data latch circuits and a control signal for dividing horizontal scanning period, wherein the output sides of said data latch circuits are connected to logic circuits, said logic circuits being connected to a common output line for processing output data from said data latch circuits.

15. An image display apparatus according to claim 14, said drive circuit unit includes a horizontal drive circuit, wherein said horizontal drive circuit is comprised of line data latch circuits in a number not smaller than said bit number n at the least and so arranged as to control said display unit in dependence on results of sequential additions of logical signals representing products of bit-based outputs of said line data latch circuits and a control signal for dividing horizontal scanning period.

* * * * *